United States Patent [19]

Crepinsek

[11] 3,961,508

[45] June 8, 1976

[54] LOCK CYLINDER HAVING A RELEASABLE CATCH

[75] Inventor: Alois Crepinsek, El Paso, Tex.

[73] Assignees: Alois Crepinsek; Lee A. Chagra; Dave McFadden, all of El Paso, Tex. ; part interest to each

[22] Filed: Dec. 12, 1974

[21] Appl. No.: 531,926

[52] U.S. Cl. ..... 70/370; 70/372; 70/451

[51] Int. Cl.[2] ..... E05B 9/08

[58] Field of Search ..... 70/370, DIG. 60, 373, 70/374, 372, 448, 451, 449

[56] References Cited

UNITED STATES PATENTS

| | | | |
|---|---|---|---|
| 391,826 | 10/1888 | Taylor | 70/370 |
| 743,695 | 11/1903 | Dimock | 70/370 X |
| 777,130 | 12/1904 | Noack | 70/370 |
| 1,684,230 | 9/1928 | Lach | 70/370 |
| 2,869,353 | 1/1959 | Imhoff | 70/370 |

FOREIGN PATENTS OR APPLICATIONS

| | | | |
|---|---|---|---|
| 97,092 | 5/1924 | Austria | 70/370 |
| 201,463 | 2/1966 | Sweden | 70/DIG. 60 |

*Primary Examiner*—Robert L. Wolfe
*Attorney, Agent, or Firm*—D. Paul Weaver

[57] ABSTRACT

In a door lock assembly, a lock cylinder is releasably fastened within a lock cylinder housing by means of a catch affixed to the lock cylinder and operatively associated with a structure, such as a lock bolt assembly, within the lock cylinder housing. The catch is released by means of an actuating pin passing from the side edge of the door into the lock cylinder housing for disengaging the catch and allowing the lock cylinder to be removed from its housing. The pin, in a preferred embodiment, is carried within the lock bolt.

5 Claims, 7 Drawing Figures

FIG. 1
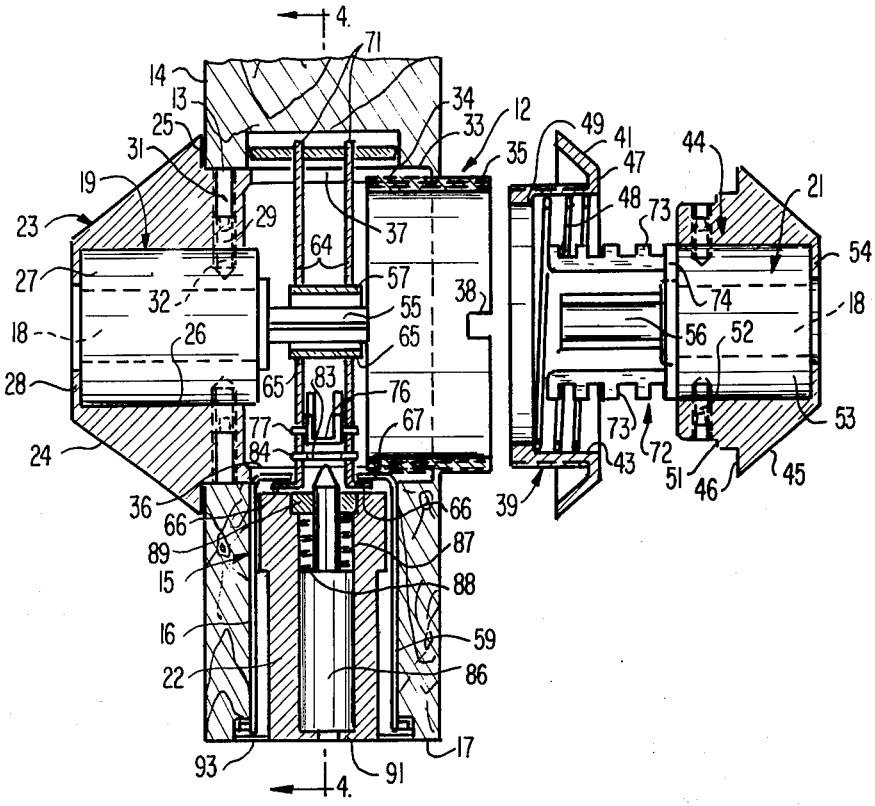
FIG. 4
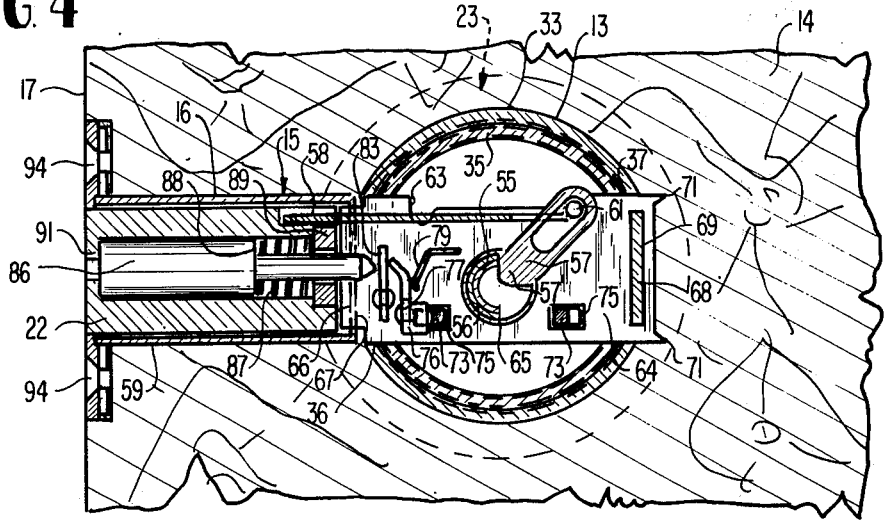
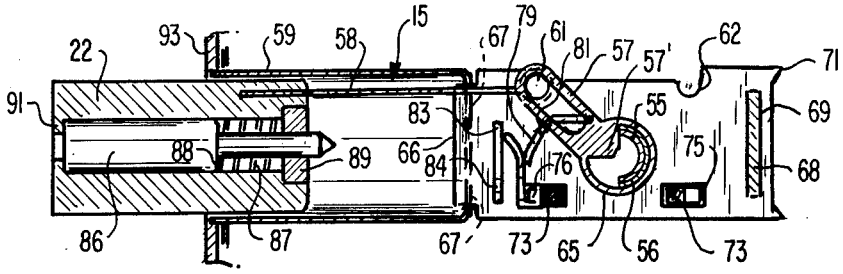
FIG. 5

LOCK CYLINDER HAVING A RELEASABLE CATCH

RELATED CASES

The lock cylinder housing having a tubular threaded coupling means coupling the inside and outside portions of the housing together forms the subject matter of and is claimed in copending U.S. application Ser. No. 531,927 filed Dec. 12, 1974.

BACKGROUND OF THE INVENTION

The present invention relates in general to door locks and more particularly to an improved door lock wherein one or more lock cylinders are captured within a cylinder housing by means of a releasable catch coupled to the lock cylinder and engaging a structure within the door.

DESCRIPTION OF THE PRIOR ART

Heretofore, lock cylinders for door locks have been captured within a cylinder housing of the lock assembly by means of one or more machine screws. Typically, one machine screw passes from the inside of the door to the outside half of the lock cylinder housing and a second screw, accessible from the outside of the door, passes from the outside half of the lock cylinder housing into the inside half of the lock cylinder housing.

One of the problems with this type of door lock arrangement, is that the outside machine screw can be removed such that the outside lock cylinder is held into the housing only by means of one machine screw inaccessible from the outside but accessible from the inside. This remaining machine screw is easily broken by means of prying or twisting on the exposed outside portion of the lock cylinder housing or may be removed by gaining access to the inside of the door.

Thus, it is desired to provide an improved door lock assembly wherein there are no machined screw fasteners accessible either on the inside or the outside of the door and wherein at least one of the lock cylinders is fastened into the lock cylinder housing in such a manner that it can only be released by access to the side edge of the door after the door has been opened with a key.

SUMMARY OF THE PRESENT INVENTION

The principal object of the present invention is the provision of an improved door lock wherein a lock cylinder is fastened into a lock cylinder housing by means of a releasable catch accessible only when the door is in the open position.

In one feature of the present invention, a lock cylinder is captured within a lock cylinder housing of the door lock assembly by means of a releasable catch mechanically coupled to the lock cylinder structure and engaging a latching means carried within the cylinder housing so that access to the releasable catch for releasing the lock cylinder from its housing is not available from either the inside or the outside of the door when the door is in the closed position.

In another feature of the present invention, a lock cylinder is releasably fastened within its housing by means of a notched structure coupled to the lock cylinder structure, such notched structure engaging a spring biased latch carried within the lock cylinder housing. A release means is included for releasing the spring biased latch from the side edge of the open door.

In another feature of the present invention, a spring biased releasable latch for fastening a lock cylinder within its housing is released by means of an actuating pin slidable within a lock bolt assembly such that depression of the pin opens the spring biased latch to release the lock cylinder from its housing.

In another feature of the present invention, means, such as an outwardly flanged insert, is mechanically coupled to the releasably latched lock cylinder to be movable therewith as a part thereof for capturing one of the flanged axially separable lock cylinder housing portions against axial translation when the lock cylinder is latched into its housing within the door. In this manner, the lock cylinder housing can't be removed without first releasing the latched lock cylinder from the side edge of the open door.

Other features and advantages of the present invention will become apparent upon a perusal of the following specification taken in connection with the accompanying drawings wherein:

BRIEF DESCRIPTION OF THE DRAWINGS

FIG. 1 is a horizontal cross sectional view, partly exploded, of a door lock assembly embodying the invention.

FIG. 4 is a fragmentary vertical section taken on line 4—4 of FIG. 1, with the dead bolt retracted.

FIG. 5 is a sectional view similar to FIG. 4 showing the dead bolt projecting in the door locking position.

DESCRIPTION OF THE PREFERRED EMBODIMENTS

Figures 2, 3:
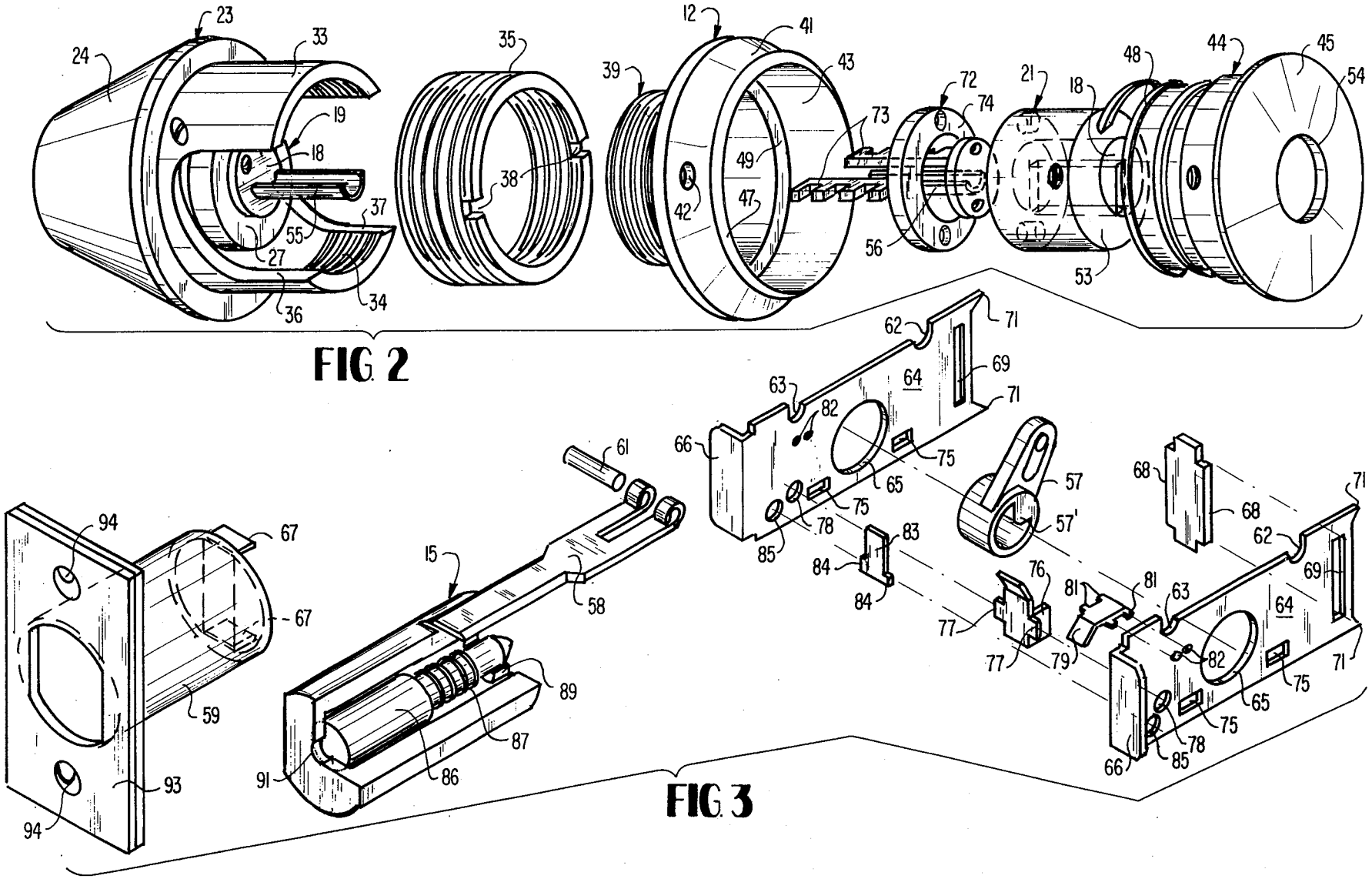
FIG. 2 is an exploded perspective view of a lock cylinder housing shown in FIG. 1 and forming particularly the subject matter of this invention.
FIG. 3 is an exploded perspective view of a dead bolt assembly and lock cylinder housing release means also shown in FIG. 1.
Figure 7:
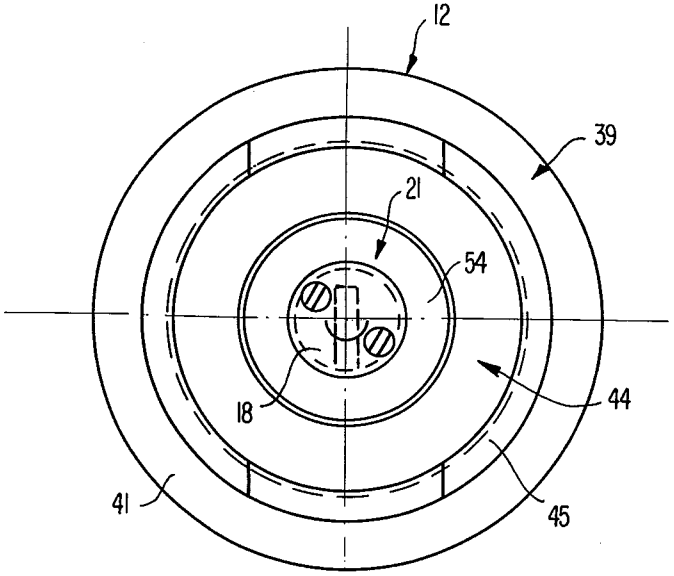
FIG. 7 is an end elevational view of the lock cylinder housing as depicted in FIG. 6.

Referring now to FIG. 1, there is shown a dead bolt door lock assembly incorporating features of the present invention. The door lock assembly includes a lock cylinder housing 12 mounted within and passing through a cylindrical transverse bore 13 in a door 14. A dead bolt lock assembly 15 is mounted within bore 16 extending towards and intersecting with transverse bore 13 from the side edge 17 of the door 14. The dead bolt lock assembly 15 includes a portion extending through the lock cylinder housing 12 and includes an actuating mechanism operatably coupled with rotatable plug portions 18 of lock cylinders 19 and 21 for moving a lock bolt 22 into and out of the door 14 for locking the door 14 to the door frame, not shown.

The lock cylinder housing 12 includes an outside or first cylindrical portion 23 having a conically flared flange 24 which, at its outer periphery catches the lip of the transverse bore 13 at 25. The outside portion 23 of the housing 12 includes an inner cylindrical bore 26 to receive the lock cylinder 19. The lock cylinder 19 includes an outer fixed annular portion 27 surrounding the unlockable and rotatable plug portion 18 having the keyway therein. The cylindrical bore 26 is partially closed at its outer end by an inwardly directed flange portion 28 which at least partially covers the outer cylindrical portion 27 of the lock cylinder 19 while leaving exposed, from the outside, the keyway passage of the plug 18. The lock cylinder 19 is held in position within the outside housing portion 23 by means of a set screw 29 threaded through a tapped bore 31 in the housing portion 23. The tapped bore 31 registers with a radial bore 32 in the annular portion 27 of the lock cylinder 19.

Referring now to FIGS. 1 and 2, the remaining portion of the lock cylinder housing 12 is more fully illustrated. The outside portion 23 of the lock cylinder housing 12 includes a tubular extension 33 extending axially of the bore 13. The tubular extension 33 is internally threaded at 34 to receive the external threads of a tubular threaded insert 35. In addition, the internal threaded extension 33 includes a pair of transversely aligned apertures or slots 36 and 37 to allow passage of the bolt lock assembly 15 therethrough.

The threaded insert 35 includes a notch 38 to receive a tool for turning insert 35 into the threaded extension of the outside portion 23 of the housing 12. The threaded insert 35 is threaded into the desired position and then the inside or second portion 39 of the housing 12 is threaded into a mating set of internal threads of the threaded insert 35. The inside half portion 39 is turned sufficiently by inserting a turning tool into hole 42 to pull the conically shaped outer flange portion 41 thereof down against the lip of bore 13 to capture the door 14 between the flange portions 24 and 41 of the opposite half portions of 23 and 39 of the lock cylinder housing 12.

The inside half 39 of the lock cylinder housing 12 includes an axial bore 43 to receive a lock cylinder insert 44. The lock cylinder insert 44 includes a conically flared flange portion 45 with a shoulder 46 at its outer periphery to receive and catch a lip 47 of the inside half 39 of the housing 12. A compression spring 48 is carried within the bore 43 and abuts at one end with an inner shoulder 49 of the housing section 39 and rides on an outer shoulder 51 of the lock cylinder insert 44 for spring biasing the insert 44 outwardly of the housing 12.

The inside lock cylinder 21 is retained within the cylinder insert 44 by means of a set screw 52 that is threaded through a tapped bore in the insert 44 and extends into an aligned radial bore in the outer annular portion 53 of the inside lock cylinder 21 for fastening the lock cylinder 21 to the insert 44. An inwardly directed lip portion 54 of the insert 44 serves to cover the outer cylindrical portion 53 of the lock cylinder 21 while leaving exposed the rotable plug 18 and keyway therein.

Figure 6:
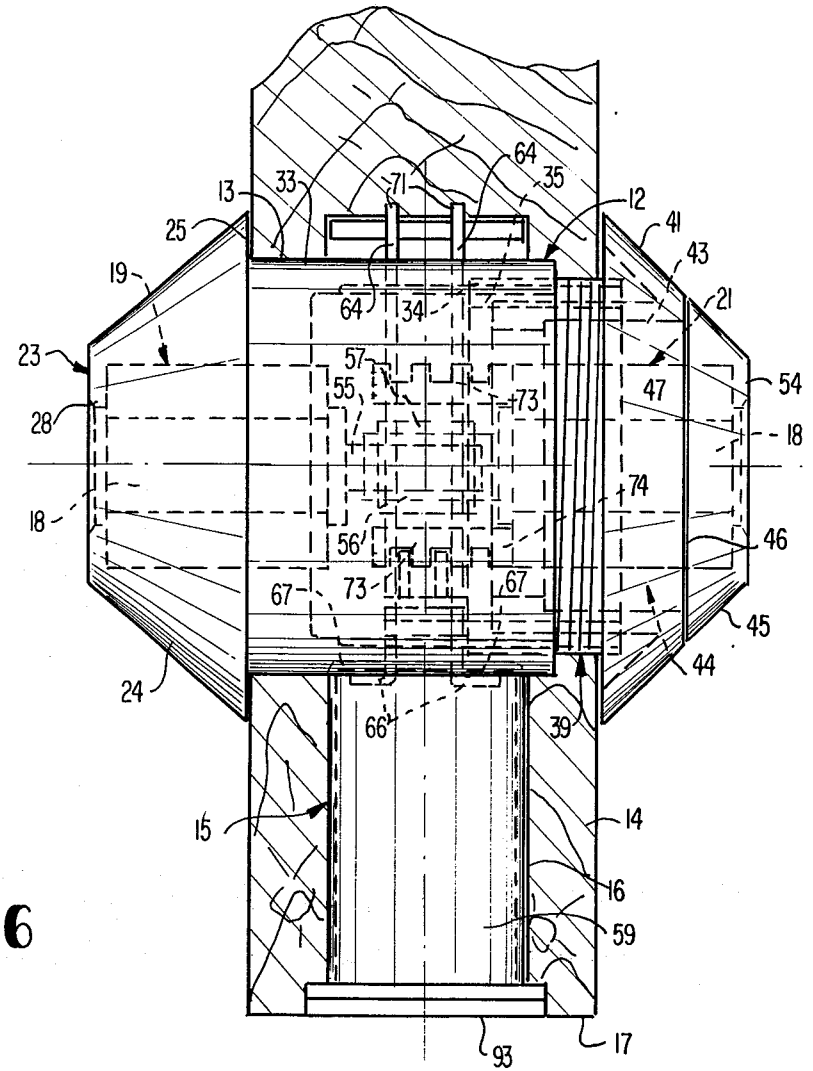
FIG. 6 is a horizontal cross section through the door equipped with the invention, similar to FIG. 1, and showing the device in completely assembled form.

Each of the lock cylinder plugs 18 includes a drive spline 55 and 56 respectively, which is fixedly secured to the respective lock cylinder plug 18 as by screws, not shown, for rotation therewith. The respective drive splines 55 and 56 are axially telescoping one within the other in assembly, FIG. 6. The outside drive spline 55 telescopes within the inside drive spline 56. A bolt drive arm 57, as shown in FIG. 3, is splined at 57 to the telescoped drive splines 55 and 56 such that rotation of the individual plug driven drive splines 55 and 56 serves to produce rotation of the lock bolt 22 via the bolt drive arm 57 which is pivotably secured via pin 61 to a lock bolt actuating link 58 which in turn is fixedly secured to the lock bolt 22 for effecting reciprocal translation of lock bolt 22 within a tubular lock bolt housing 59.

In the unlocked position of the lock bolt 22, the pin 61 rides in notches 62 in the upper lip of lock bolt housing side plates 64, whereas in the locked position of the lock bolt 22, the pin 61 rides in notches 63 of the side plates 64. The side plates 64 include axially aligned central openings 65 to allow passage of the drive splines 55 and 56 therethrough. The outer end 66 of each of the side plates 64 is locked behind inwardly directed flange portions 67 at the inner end of the tubular lock bolt housing 59. The inside ends of the side plates 64 are locked together by means of locking tabs 68 which pass through aligned slots 69 in the side plates 64. The tabs 68 are bent over the outside of the side plates 64 for closing off and locking the inside ends of the side plates together. Two prongs 71 are formed on the inner ends of the side plates 64 so that the bolt lock housing can be driven into the wood of the door 14.

A lock cylinder catch structure 72 includes a pair of notched leg portions 73 carried from a mounting ring 74 which is fixedly secured to the end of the outer cylindrical portion 53 of the inside lock cylinder 21. The notched legs 73 pass through a pair of rectangular slots 75 in each of the side plates 64 of the lock bolt housing assembly 15. A spring biased latch member 76 is pivotably mounted within the bolt housing assembly 15 by means of a pair of outwardly directed tabs 77 carried by the latch 76 which ride in aligned apertures 78 in the side plates 64. The latch 76 is free to pivot about the tab supports 77 and is spring biased into latching engagement with the notched portions of the notched legs 73 of the catch structure 72 via a spring 79.

The spring 79 is mounted between the side plates 64 via pairs of tabs 81 passing through pairs of aligned apertures 82 in the side plates 64. An actuating lever 83 is pivotably mounted between the side plates 64 via tabs 84 extending through aligned apertures 85 in the side plate structures 64. The upper end of the actuating lever 83 engages the upper end of the spring biased latch 76, FIGS. 4 and 5, for pivoting the latch 76 about its pivotable support tabs 77 to a position out of latching engagement with the notched portion 73 of the catch 72.

The actuating lever 83 is actuated by means of an axially translatable actuating pin 86 contained within an axial bore of the lock bolt 22. The actuating pin 86 is captured within the lock bolt 22 and spring biased toward the outer end thereof via a compression spring 87 captured between a shoulder 88 of the pin 86 and a centrally apertured plug 89 threaded into the end of the lock bolt 22. The outer end of the lock bolt 22 includes an inwardly directed centrally apertured flange 91 for capturing the actuating pin 86 within the lock bolt 22 against the spring bias of spring 87.

The lock cylinder 21 and its insert 44 are locked into position via the catch assembly 72 by pressing the insert 44 and retained lock cylinder 21 into the cylinder housing 12 from the inside end so that the notched leg structure 73 passes through the aligned apertures 75 in the side plates 64 of the bolt housing 15. The latch 76 is first rotated out of locking engagement during insertion of the catch structure by pressing the actuating pin 86 into engagement with the actuating lever 83 and tilting the latch 76 away from the notches 73. Any suitable tool, such as a nail or punch, may be utilized for pressing the pin 86 into engagement with the actuating lever 83.

After the notches of the catch structure 72 have moved to the fullest inner extent of travel, the inwardly directed pressure on the actuating pin 86 is removed so that the spring 79 pivots the latch 76 into latching engagement with the catch structure 72, thereby locking the lock cylinder 21 and its insert 44 in position against the outer end of the inside flared portion 39 of the cylinder housing 12. When the insert 44 is locked in position it serves like a lock nut to prevent rotation and thus removal of the inside portion 39 of the cylinder housing 12. The cylinder insert 44 also protects the inside lock cylinder 21.

The inside lock cylinder 21 is released for removal only by opeining the door 14 with a key and pressing the actuating pin 86 so as to release the spring loaded latch 76 allowing the cylinder insert spring 48 to push the insert 44 and attached lock cylinder 21 out of the lock cylinder housing 12 for replacement.

The opposite side edges of the lock bolt 22 are flattened to pass through similarly flattened edges of an aperture in a door plate structure 93 affixed to the outer end of the lock bolt housing 59. The door plate structure 93 is secured to the edge of the door via screws 94. The actuating pin 86 is freely rotatable within the lock bolt 22 and is preferable made of a hardened steel material to resist sawing. When a saw reaches the pin 86, the hardened pin 86 will rotate with movement of the saw, thereby frustrating the sawing action.

Referring now to FIG. 4 and 5, there is shown in FIG. 4, the position of the lock bolt actuating pin 86 when the lock is unlocked. It is seen that the inner end of the actuating pin 86 is relatively close to the actuating lever 83 so that only a relatively slight inner movement of the actuating pin 86 is required to engage the actuating lever 83 and unlock the spring biased latch 76.

FIG. 5 shows the lock bolt in the locked position. In this position it is seen that the inner end of the actuating pin 86 is removed sufficiently from the actuating lever 83 so that the spring biased latch 76 cannot be disengaged from locking engagement with the notched catch structure 73 by depression of the actuating pin 86.

It is only when the door 14 has been unlocked by means of a key that the inside lock cylinder 21 and cylinder insert 44 can be removed which then permits the lock 11 to be disassembled.

Although a separate threaded insert 35 has been employed for coupling the inside and outside halves of the lock cylinder housing 12 together, this is not a requirement and the inner ends of the two halves 23 and 39 may be directly threadably mated to effect the coupling directly when relatively thin doors are involved.

The advantage of the lock assembly of the present invention is that the inside half 39 and the outside half 23 of the lock cylinder housing 12 are coupled together by means of a threaded insert 35 which is a relatively strong member such that breaking of the lock apart, such as prying, is extremely difficult. In addition, the lock cylinders 19 and 21 are protected by means of the inwardly directed flange portions 28 and 54 and can only be removed by release of the spring biased catch 72 which in-turn can only be accomplished after the door 14 has been unlocked and is in the open position.

There are no machine screws or other coupling means accessible from the outside of the door for partially disassembling the lock structure. Furthermore, the lock cylinder housing 12 cannot be disassembled by unscrewing either the outer half 23 or the inner half 39 of the housing 12 because the outer half 23 is rotationally captured by the transverse bolt housing 15 and the inner half 39 is captured, in lock nut fashion, by the captured lock cylinder insert 44. Additionally, the threaded insert coupler 35 for coupling together the two halves 23 and 39 of the lock cylinder housing 12 permits axial telescopic adjustment of the length of the housing 12 so as to accommodate doors 14 of widely differing thicknesses.

What is claimed is:

1. In a door lock assembly, lock cylinder means at least partially housed within a housing to pass into a transverse bore in a door to be locked near one edge thereof, said lock cylinder means disposed in mechanical operative association with a lock bolt assembly carried by the door for effecting translation of the lock bolt into and out of the edge portion of the door by rotation of a portion of said lock cylinder means, fastening means releasably fastening said lock cylinder means to a structure disposed within said transverse bore in the door, and release means operatively associated with said fastening means and accessible to an operator when installed in the door only from said edge of the door when the door is at least partially open for releasing said fastening means to permit removal of the lock cylinder means, said release means including actuating means movable in a direction toward said releasable fastening means from said door edge, and said actuating means including an axially translatable actuating member carried with and axially translatable relative to the lock bolt, and spring bias means for biasing said actuating member relative to said bolt so as to urge said actuating member out of operative engagement with said fastening means.

2. In a door lock assembly, lock cylinder housing means adapted for mounting in a transverse through bore formed in a door between the opposite sides thereof, said housing means including interior and outer housing sections and means coupling said housing sections in assembled relationship in said through bore, fastening means carried by the lock cylinder housing means and disposed within the through bore, and a lock bolt assembly carried by the door adjacent one edge thereof and having a bolt translational axis normal to the axis of said through bore and lock cylinder housing means, said lock bolt assembly disposed in intersecting relation to the lock cylinder housing means and preventing rotation of the latter within the through bore, and a translational release means for said fastening means on the lock bolt assembly accessible only at said one edge of the door when the door is at least partly open, and being normally biased away from engagement with said fastening means.

3. In a door lock assembly as defined by claim 2, said fastening means comprising toothed catch means, and said translational release means including a releasable latch element normally engaged with the toothed catch means and disengaged therefrom by operation of the translational release means.

4. In a door lock assembly as defined by claim 3, and said translational release means further including a translational plunger element on the bolt of said lock bolt assembly and being axially movable relative to the bolt into engagement with said latch element.

5. In a door lock assembly as defined by claim 4, and the biasing means for said translational release means comprising a coil spring opposing said plunger element, said plunger element and spring contained within a bore of said bolt.

* * * * *